US012662229B1

(12) United States Patent
Carvalho-Ruehle et al.

(10) Patent No.: US 12,662,229 B1
(45) Date of Patent: Jun. 23, 2026

(54) SYSTEMS AND METHODS FOR CONTROLLING AN IMAGING SYSTEM OF A MARINE VESSEL

(71) Applicant: Brunswick Corporation, Mettawa, IL (US)

(72) Inventors: Raíssa Carvalho-Ruehle, Charlotte, MI (US); Anna R. Chi, Lisle, IL (US); Lauren McLeod, Gainesville, FL (US); Jon M. Nowick, Milwaukee, WI (US); Brandon L. Tate, Walnut Hill, IL (US)

(73) Assignee: Brunswick Corporation, Mettawa, IL (US)

( * ) Notice: Subject to any disclaimer, the term of this patent is extended or adjusted under 35 U.S.C. 154(b) by 330 days.

(21) Appl. No.: 18/467,386

(22) Filed: Sep. 14, 2023

(51) Int. Cl.
*B63H 25/04* (2006.01)
*B63B 49/00* (2006.01)
*B63B 79/10* (2020.01)

(52) U.S. Cl.
CPC ..... *B63H 25/04* (2013.01); *B63B 49/00* (2013.01); *B63B 79/10* (2020.01)

(58) Field of Classification Search
CPC ..... B63H 25/04; B63B 49/00; B63B 79/10
See application file for complete search history.

(56) References Cited

U.S. PATENT DOCUMENTS 7,476,862 B2 1/2009 Staerzl
10,372,976 B2 8/2019 Kollmann et al.
11,198,494 B2 12/2021 Derginer et al.
11,383,800 B2 7/2022 Terada et al.
11,443,637 B2 9/2022 Malouf et al.
2011/0297070 A1* 12/2011 Riggs ..... B63G 8/18 114/330
2021/0166568 A1* 6/2021 Kersulec ..... G05D 1/49
2025/0201129 A1* 6/2025 Kersulec ..... G05D 1/49

OTHER PUBLICATIONS

Cojoc-Wisernig, E. Marine Visualization System: An Augmented Reality Approach, Google Scholar, Dissertation, University of Victoria, Department of Science, 2020, pp. 1-186. (Year: 2020).*

* cited by examiner

*Primary Examiner* — Russell Frejd
(74) *Attorney, Agent, or Firm* — Andrus Intellectual Property Law, LLP

(57) ABSTRACT

An imaging system for a marine vessel is provided. The marine vessel includes a propulsion system configured to provide thrust that propels the marine vessel in a propulsion direction having a surge component, a sway component, and a yaw component. The imaging system includes multiple imaging sensors positioned to image multiple directions around the marine vessel and configured to generate image data, a display device configured to display at least a portion of the image data, and a control system. The control system is configured to select a first portion of the image data based on each of the surge component, the sway component, and the yaw component of the propulsion direction, and display the selected first portion of the image data on the display device.

20 Claims, 9 Drawing Sheets

SYSTEMS AND METHODS FOR CONTROLLING AN IMAGING SYSTEM OF A MARINE VESSEL

FIELD

The present disclosure generally relates to controlling an imaging system for a marine vessel, and more particularly to systems and methods for selecting images from the imaging system that are displayed on a display device.

BACKGROUND

The following U.S. Patents and Patent Publications provide background information and are incorporated herein by reference, in entirety:

U.S. Pat. No. 7,476,862 discloses a method for detecting a source of heat near a vessel. Two sensor units are mounted on opposite sides of a transom of a boat and directed to a common location behind the boat. The field of view of the two sensors overlaps behind the marine propulsion unit of the boat to detect the presence of a heat emitting object, such as a mammal. Housing structures contain infrared sensing elements, lenses, and light shields. Signals from four infrared sensing elements are received by a controller which reacts, with an alarm signal, when at least two of the four sensors detect a heat emitting object within their individual fields of view. False triggering can be reduced by not providing an alarm signal if only the two most inboard sensors detect the heat emitting object.

U.S. Pat. No. 10,372,976 discloses an object detection system for a marine vessel having at least one marine drive includes at least one image sensor positioned on the marine vessel and configured to capture an image of a marine environment on or around the marine vessel, and a processor. The object detection system further includes an image scanning module executable on the processor that receives the image as input. The image scanning module includes an artificial neural network trained to detect patterns within the image of the marine environment associated with one or more predefined objects, and to output detection information regarding a presence or absence of the one or more predefined objects within the image of the marine environment.

U.S. Pat. No. 11,198,494 discloses a propulsion control system for a marine vessel that includes a plurality of propulsion devices steerable to propel the marine vessel, at least one proximity sensor that determines a relative position of the marine vessel with respect to an object, wherein the at least one proximity sensor has a field of view (FOV). A controller is configured to identify a trigger condition for expanding the FOV of the at least one proximity sensor and control thrust and/or steering position of at least one of the plurality of propulsion devices to expand the FOV of the at least one proximity sensor by inducing a roll movement or a pitch movement of the marine vessel.

U.S. Pat. No. 11,443,637 is directed to a proximity sensor system on a marine vessel that includes one or more proximity sensors, each at a sensor location on the marine vessel and configured to measure proximity of objects and generate proximity measurements. A processor is configured to store a two-dimensional vessel outline of the marine vessel with respect to a point of navigation for the marine vessel, receive the proximity measurements measured by one or more proximity sensors on the marine vessel, and identify four linearly-closest proximity measurements to the two-dimensional vessel outline, including one closest proximity measurement in each of a positive X direction, a negative X direction, a positive Y direction, and a negative Y direction. The processor then generates a most important object (MIO) dataset identifying the four linearly-closest proximity measurements.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one implementation of the present disclosure, an imaging system for a marine vessel is provided. The marine vessel includes a propulsion system configured to provide thrust that propels the marine vessel in a propulsion direction having a surge component, a sway component, and a yaw component. The imaging system includes multiple imaging sensors positioned to image multiple directions around the marine vessel and configured to generate image data, a display device configured to display at least a portion of the image data, and a control system. The control system is configured to select a first portion of the image data based on each of the surge component, the sway component, and the yaw component of the propulsion direction, and display the selected first portion of the image data on the display device.

According to another implementation of the present disclosure, a method for controlling an imaging system for a marine vessel having a propulsion system configured to provide thrust that propels the marine vessel in a propulsion direction having a surge component, a sway component, and a yaw component is provided. The method includes imaging multiple directions around the marine vessel to generate image data using multiple imaging sensors, selecting a first portion of the image data based on each of the surge component, the sway component, and the yaw component of the propulsion direction, and displaying the selected first portion of the image data on the display device.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

As the size of consumer marine vessels has increased, the operators of such vessels may rely more heavily on imaging systems that provide 360° views of the marine environment surrounding the vessel, as opposed to their own ability to see and respond to obstacles in the water. For example, an imaging system may include multiple imaging sensors (e.g., cameras) that provide images of the area around the marine vessel to permit an operator to confirm that there are no obstructions that would imperil propulsion of the vessel in a particular direction or towards a particular docking structure. Such imaging systems may also provide critical safety functions for the marine vessel by permitting the operator to visually confirm that no persons are swimming within a range of the marine drives and/or the vessel path.

The inventors have further recognized that the amount of space available on a user interface to display image data from the image sensors is limited, and such systems run the risk of overwhelming the operator with irrelevant image displays or reliance on the operator to decide which image data should be magnified on a display device. The systems and methods of the present disclosure therefore automatically select relevant portions of the image data captured by various image sensors based on the propulsion direction or other propulsion behavior of the vessel, a target docking location for the vessel, and/or detected objects in the water, among other factors. Once selected, the most relevant portions of the image data are displayed to the operator in a way that highlights the most relevant image data, thereby significantly increasing the case of operating vessels with such imaging systems.

Figure 1:
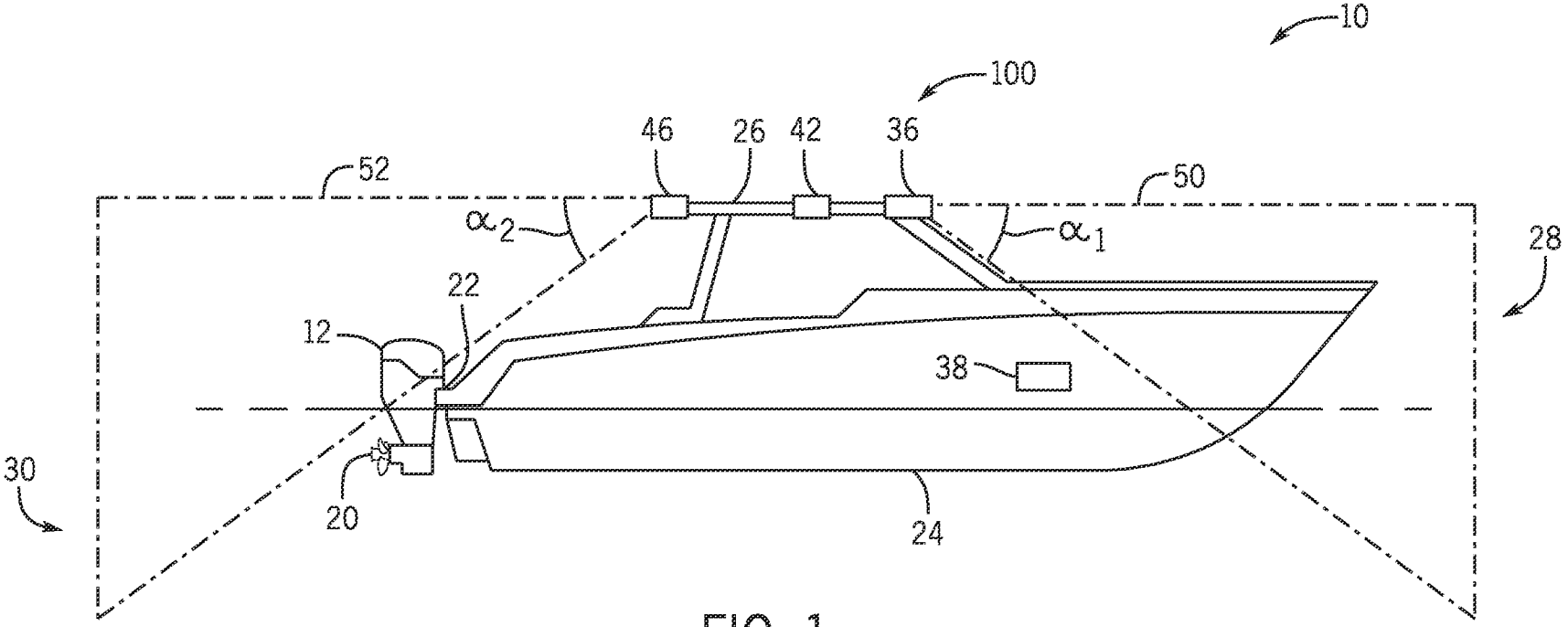
FIG. 1 illustrates a side view of an exemplary marine vessel having an imaging system with imaging sensors.
Figure 2:
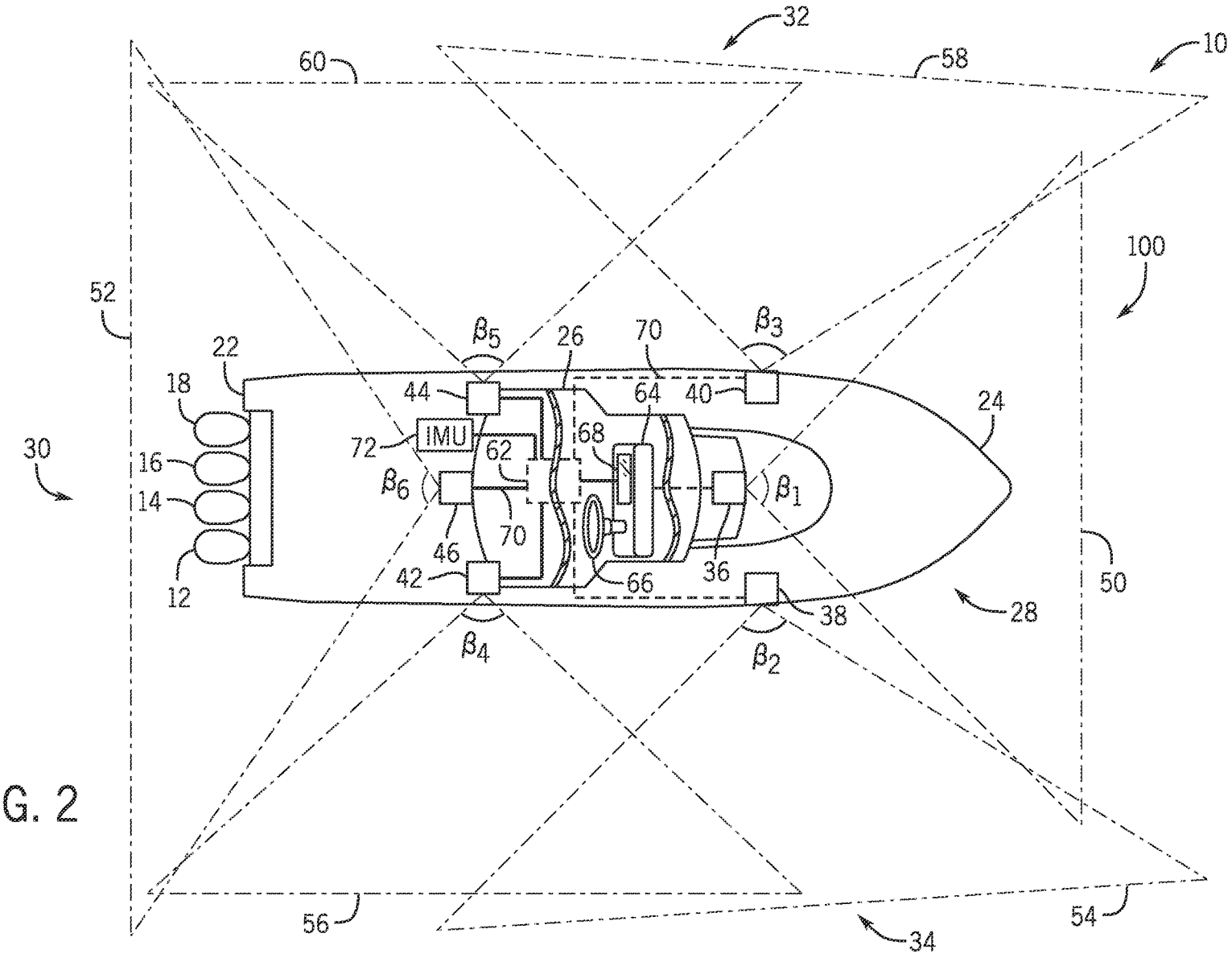
FIG. 2 illustrates a top view of the marine vessel of FIG. 1.

FIGS. 1 and 2 depict side and top views, respectively, of a marine vessel 10 equipped with an imaging system 100 configured according to an exemplary embodiment of the disclosure. The marine vessel 10 is shown to extend between a bow end 28 and a stern end 30, and between a port side 32 and a starboard side 34. The propulsion control system of the marine vessel 10 includes multiple marine drives 12, 14, 16, 18 positioned at the bow end 28 and coupled to a transom 22 of the vessel hull 24 that produce thrusts to propel the vessel. As illustrated, each of the marine drives 12-18 is an outboard motor. However, the type of marine drive utilized is not particularly limited, and other exemplary embodiments may include inboard motors, stern drives, pod drives, trolling motors, jet drives, or the like. In addition, the marine drives may use any suitable propulsion technology (e.g., internal combustion engines, electric motors) to drive rotation of a propeller 20 (see FIG. 1). Each of the marine drives 12-18 may be independently steerable or rotatable about a vertical steering axis in order to control the direction of the thrust provided by the marine drive.

As best shown in FIG. 2, the imaging system 100 of the marine vessel 10 includes imaging sensors 36, 38, 40, 42, 44, 46 that image the area around the vessel 10. The systems and methods disclosed herein are described with reference to an imaging system that includes one imaging sensor 36 that primarily images an area in front of the bow end 28 of the vessel, one imaging sensor 46 that primarily images an area behind the stern end 30 of the vessel, two imaging sensors 40, 44 that primarily image an area proximate the port side 32 of the vessel, and two imaging sensors 38, 42 that primarily image an area proximate the starboard side 34 of the vessel. Accordingly, every direction of the marine environment surrounding the vessel 10 may be captured by at least one of the imaging sensors 36-46, and the imaging sensors 36-46 may be configured to capture different heights and distance ranges around the vessel 10. The systems and methods of the present disclosure are not limited to the specific arrangement of image sensors 36-46 depicted herein, and in other embodiments, a different number and arrangement of image sensors may be utilized.

According to an exemplary embodiment of the present disclosure, some of the imaging sensors (e.g., imaging sensors 36, 42, 44, 46) may be mounted on a hardtop structure 26 that extends above the hull 24 and is configured to provide shade and protect the occupants of the vessel 10 from adverse weather conditions. In other embodiments, the imaging sensors may be mounted on a different structural element to image the area around the vessel 10, for example, the vessel hull 24.

Each of the imaging sensors 36-46 is configured to image the marine environment on and/or around the marine vessel 10, and each of the imaging sensors 36-46 may be a visual light camera, an infrared camera, radar, lidar, etc. or other sensor configured to image of the stern end 30 and area behind the marine vessel 10. The imaging sensors 36-46 generate electronic image data that is transmitted to a controller or control unit 62 of the propulsion system (see FIG. 2). One or more of the imaging sensors 36-46 may be arranged and configured as a stereovision system enabling depth and distance measurements based on pixel disparity. As described in further detail below, once transmitted to the controller 62, portions of the images from the sensors 36-46 may be combined and processing functions may be performed on the combined image by the controller 62. For example, these processing functions may include identification of blind spots within the combined image, and object detection within the combined image. The controller 62 may further integrate sensor data from one or more types of sensors 36-46 into one or more models of an environment of vessel 10, objects within the environment, and/or the vessel 10 itself. In such embodiments, the model(s) can be in any suitable format, such as one or more point clouds, one or more maps, and/or one or more occupancy grids integrating location information from multiple sensors. The controller 62 may further translate location data from different sensors 36-46 into a common reference frame (e.g., defined by a global coordinate system).

The imaging sensors 36-46 are shown to have vertical and horizontal field of view (FOV) constraints that represent the maximum area of a subject that the image sensors are able to capture. For example, the vertical FOV 50 of the imaging sensor 36 and FOV 52 of the imaging sensor 46 (see FIG. 1) may be represented by angles $\alpha_1$, $\alpha_2$ respectively and both may be approximately 45° below a horizontal plane extending from the imaging sensors 36, 46. The horizontal FOV 50-60 corresponding to the imaging sensors 36-46 (see FIG. 2) may be represented by angles $\beta_1$-$\beta_6$ respectively. Each may be approximately 45°, although the FOV of each imaging sensor 36-46 may vary based on the installation location of the sensor, for example, the horizontal FOV 52 of the imaging sensor 46 positioned to image the stern end 30 of the vessel 10 may have a slightly wider FOV than the FOV of the imaging sensors 38, 40, 42, 44 configured to image the port and starboard sides 32, 34 of the vessel. As shown, portions of the FOV 50-60 overlap with each other such that certain regions and objects may be imaged by multiple sensors. In other implementations, the vertical and horizontal FOVs of the sensors 36-46 may be larger or smaller than those depicted in FIGS. 1-2.

Still referring to FIG. 2, the controller 62 is shown to be communicatively coupled to the marine drives 12-18 and the imaging sensors 36-46 for the purpose of receiving and sending signals thereto. Controller 62 may be programmable and may include a processor and memory. The controller 62 can be located anywhere in the vessel 10 and can communicate with various components of the vessel 10 via wired and/or wireless links, as will be explained further herein below. Although FIG. 2 shows a single controller 62, the propulsion system can include more than one controller 62. Each controller 62 can have one or more control sections or control units. One having ordinary skill in the art will recognize that the controller 62 can have many different forms and is not limited to the example that is shown and described.

In some examples, the controller 62 may include a computing system that includes a processing system, storage system, software, and input/output (I/O) interfaces for communicating with devices such as those shown in FIG. 2, and about to be described herein. The processing system loads and executes software from the storage system, such as software programmed with an image portion selection control method. When executed by the computing system, the image portion selection software directs the processing system to automatically select and display the most relevant or important portions of the image data generated by the imaging sensors 36-46 on a display device for the operator. The computing system may include one or many application modules and one or more processors, which may be communicatively coupled. The processing system can include a microprocessor and other circuitry that retrieves and executes software from the storage system. The processing system can be implemented within a single processing device but can also be distributed across multiple processing devices or sub-systems that cooperate in existing program instructions. Non-limiting examples of the processing system include general purpose central processing units, application-specific processors, and logic devices.

The storage system (e.g., memory) can comprise any storage media readable by the processing system and capable of storing software. The storage system can include volatile and non-volatile, removable and non-removable media implemented in any method or technology for storage of information, such as computer-readable instructions, data structures, program modules, or other data. Non-limiting examples of storage media include random access memory, read only memory, optical discs, flash memory, virtual memory and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In this example, the controller 62 communicates with one or more components of the vessel 10 (e.g., marine drives 12-18, imaging sensors 36-46) via wired or wireless communications links 70. The controller 62 is capable of monitoring and controlling one or more operational characteristics of the vessel 10 and its various subsystems by sending and receiving control signals via the communications links 70. In one example, the communications links 70 are a controller area network (CAN) bus, but other types of links could be used. It should be noted that the extent of the connections shown herein are for schematic purposes only, and not every connection is shown in the drawings for purposes of clarity.

The controller 62 is further shown to be coupled to a user interface unit 64 having a steering wheel 66 and a display device 68. The controller 62 is configured to receive steering input from the steering wheel 66 to control a propulsion direction of the vessel 10 that may include surge, sway, and/or yaw components. The steering wheel 66 may be utilized in conjunction with a control lever (not shown) that allows the operator to choose to operate the marine drives 12-18 of the marine vessel 10 in neutral, forward, or reverse gear. In other implementations, a joystick device may also be utilized in place of or in combination with the steering wheel 66 for steering. The display device 68 may be a touchscreen or other operator input device that can be used to initiate or exit any number of control or operation modes, for example, an autodocking mode. Inputs to the display device 68 can be buttons in the traditional sense or selectable screen icons. The display device 68 can display information about the vessel 10 to the operator of the vessel, such as engine speed, vessel speed, trim angle, propulsion system operating mode, etc.

In an exemplary embodiment, the controller 62 may also be coupled to an inertial measurement unit (IMU) 72. The IMU 72 may serve as a direction sensor, as it detects a current, actual heading of the vessel 10. The IMU 72 may also act as a rotational sensor, as it is capable of detecting a change in heading over time, otherwise known as yaw rate or angular velocity. In certain embodiments of the IMU 72, it comprises a differential correction receiver, accelerometers, angular rate sensors, and a microprocessor which manipulates the information obtained from these devices to provide information relating to the current position of the vessel 10, in terms of longitude and latitude, the current heading of the vessel 10 with respect to north, and the velocity and acceleration of the vessel 10 in six degrees of freedom. As described in further detail below, in some embodiments, the controller 62 utilizes inputs received at the user interface 64 (e.g., steering wheel 66) to determine a propulsion direction for the vessel 10 and select portions of image data from the image sensors 36-46 for display based on the propulsion. In other embodiments, the controller 62 utilizes sensor readings from the IMU 72 to determine the propulsion direction.

Figure 3:
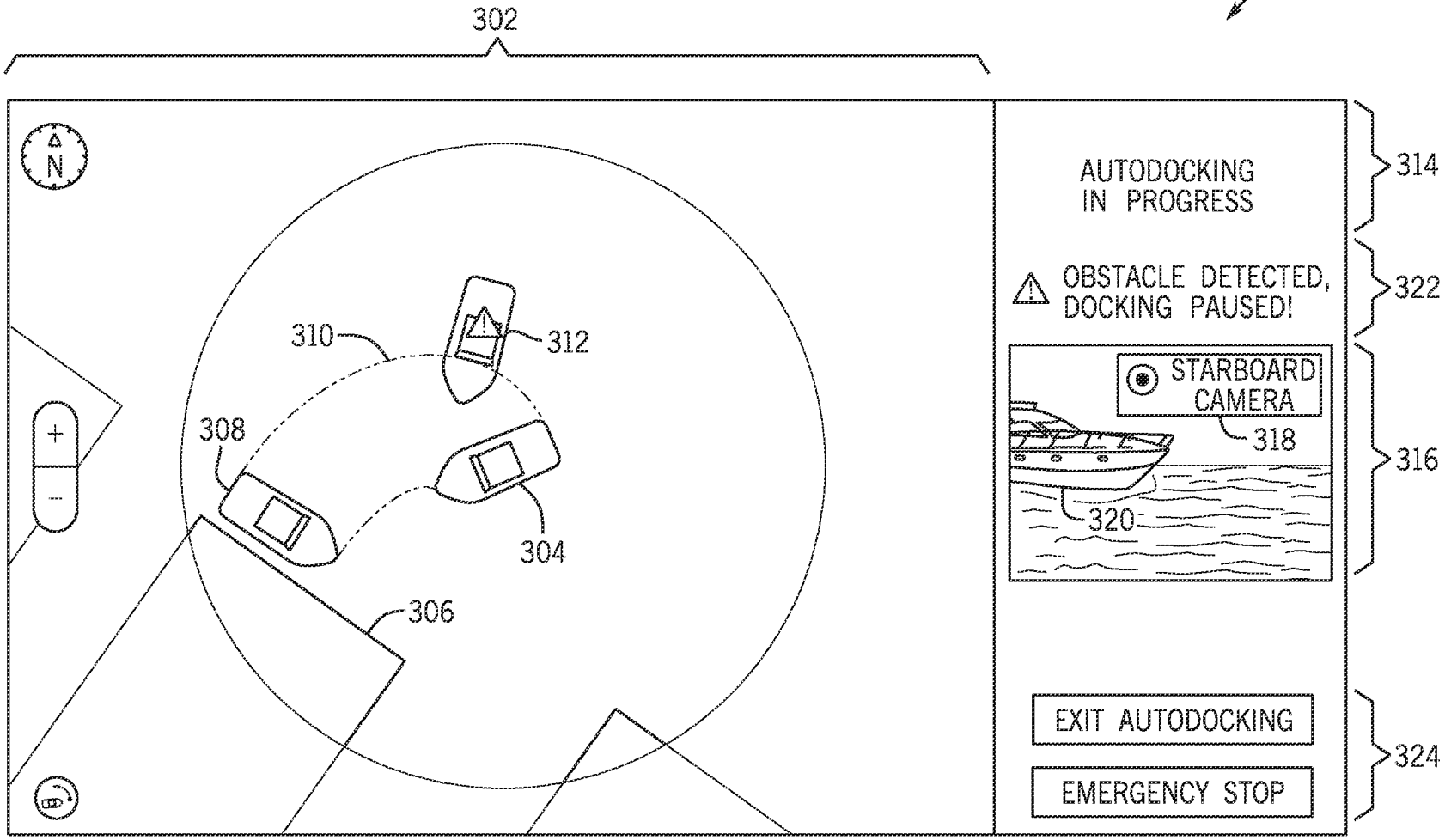
FIG. 3 illustrates an exemplary display populated by image data from the imaging system of FIG. 1 during a docking operation.
Figure 4:
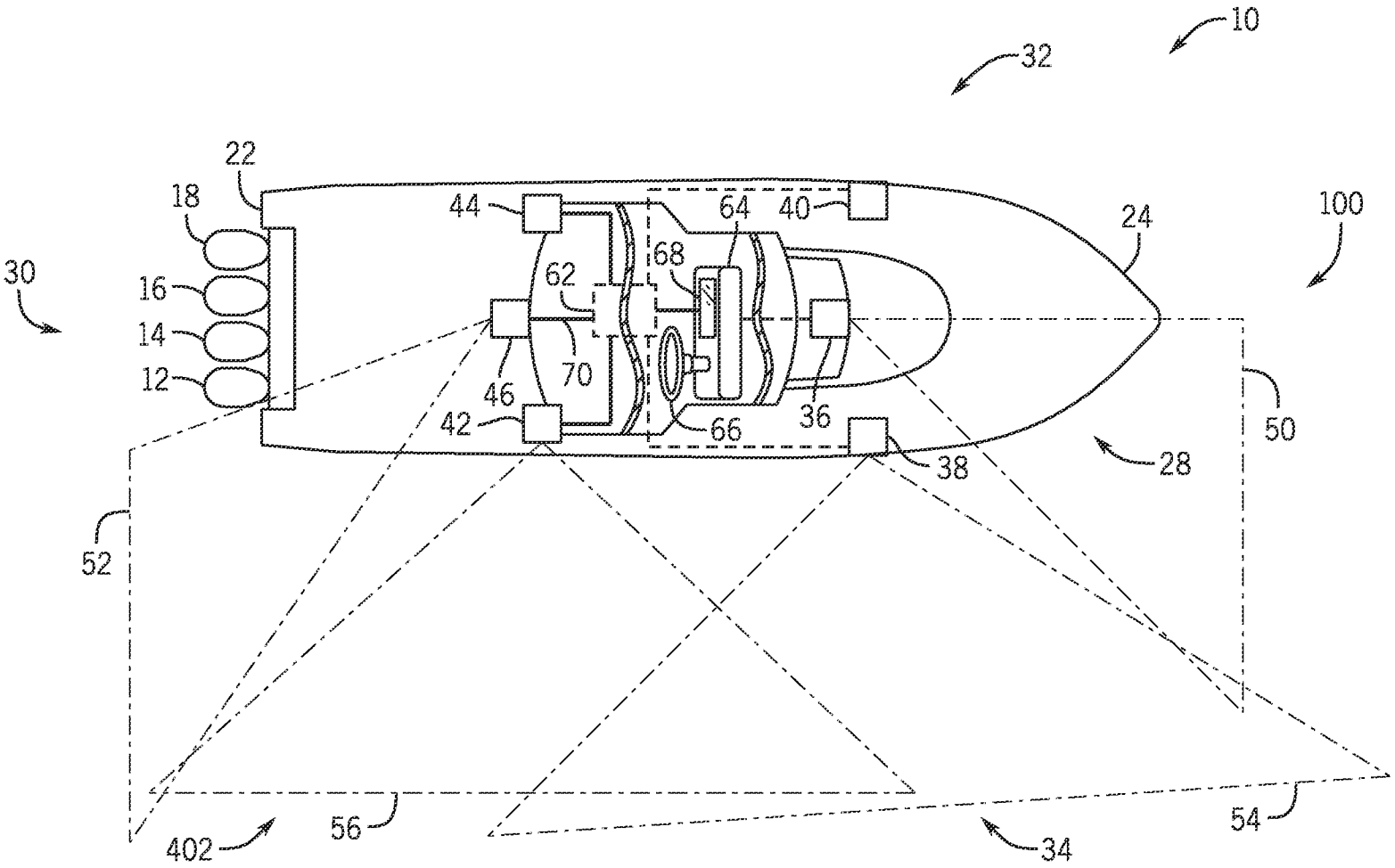
FIGS. 4 and 5 illustrate top views of the marine vessel of FIG. 1 during the docking operation of FIG. 3.
Figure 5:
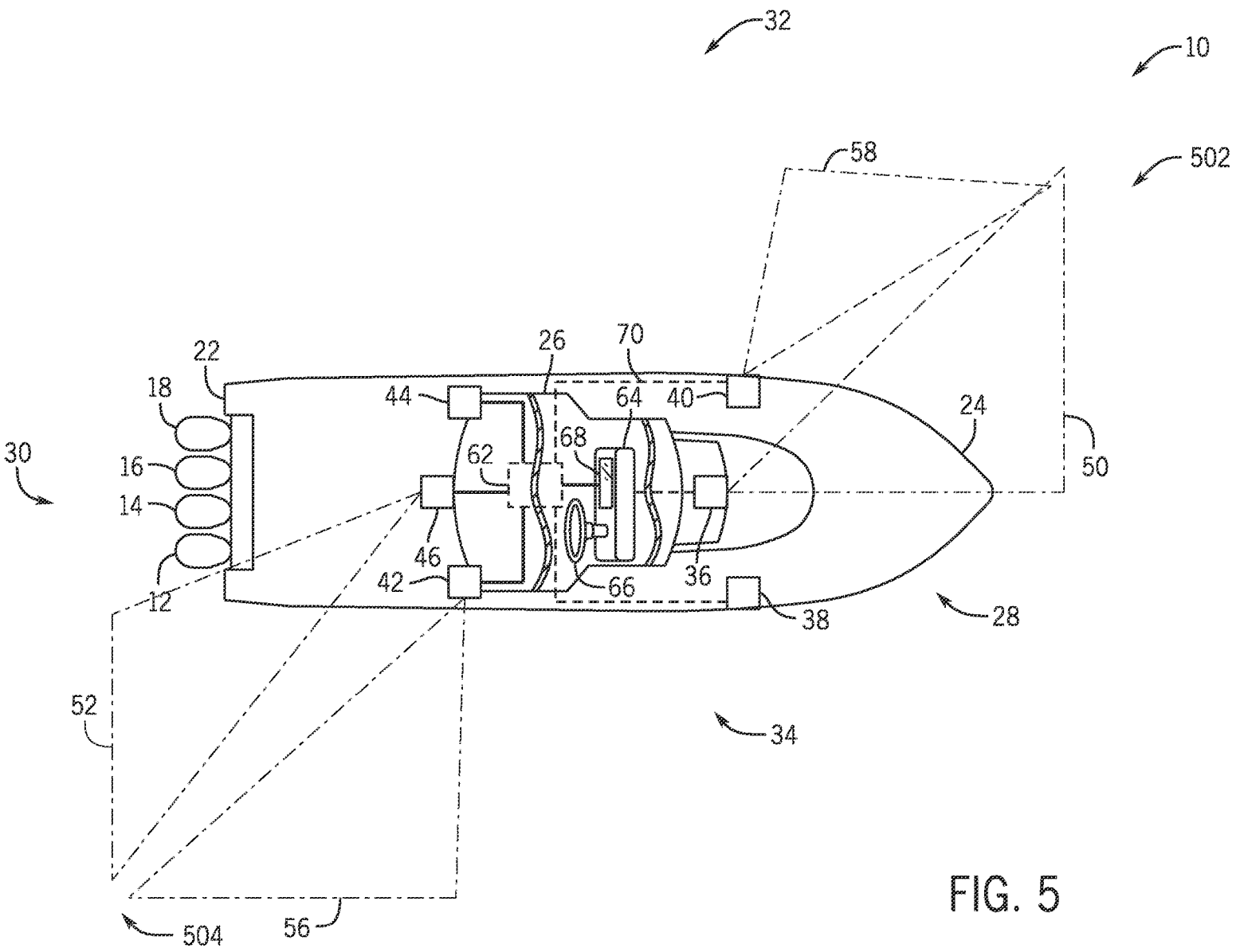

Turning now to FIGS. 3-5, an exemplary operation of the imaging system 100 during an autodocking procedure is depicted. FIG. 3 depicts a user interface display 300 that may be displayed to an operator on a display device (e.g., display device 68). In an exemplary embodiment, the user interface display 300 includes a navigation display component 302 that depicts an icon 304 of the vessel 10 and corresponds to the current position of the vessel. To initiate the autodocking procedure according to known methods, an operator may select a docking target (e.g., dock structure 306). Initiation of the autodocking mode may be confirmed by an operational mode display 314 located in the upper corner of the user interface display 300.

Based on the docking target, the controller 62 may determine a target navigation location 308 for the vessel 10 and a predicted travel path 310. For example, as shown in FIG. 3, the predicted travel path 310 to propel the vessel 10 to the target navigation location 308 may include the marine drives 12-18 providing thrusts to the vessel 10 in a propulsion direction that has both a yaw component (i.e., to rotate the vessel 10 counterclockwise such that the bow end 28 of the vessel 10 changes from southwest-facing to southeast-facing) and a subsequent sway component (i.e., to propel the vessel 10 toward the dock structure 306). In an exemplary embodiment, the target navigation location 308 is a docking location, but in other embodiments the target navigation location 308 could include any visible target location to which the vessel 10 is able to navigate. In this way, the imaging system 100 can provide the operator with view(s) of the target navigation location as the vessel 10 turns and regardless of the predicted travel path 310 without requiring the operator to manually switch between camera views.

Based on the propulsion direction and/or the target navigation location (described in further detail below with reference to FIGS. 8 and 9), the controller 62 selects portions of the image data generated by one or more of the imaging sensors 36-46 to be displayed in the image display 316. For example, and as indicated by imaging sensor label 318, when the propulsion direction of the vessel 10 includes a sway component toward the starboard side 34 of the vessel 10, the controller 62 may select portions 402 of the image data generated by one or more of the imaging sensors 36, 38, 42, and 46 having corresponding FOV 50, 52, 54, and 56 (see FIG. 4) that image the marine environment off of the starboard side 34 of the vessel 10. In an exemplary embodiment, the controller 62 selects portions of the generated image data for display that span an entirety of a side of the marine vessel (e.g., the starboard side) from the bow end 28 to the stern end 30.

As another example, when the propulsion direction of the vessel 10 includes a yaw component, the controller 62 may select portions of the image data generated by a subset of the imaging sensors 36-46. For example, if the vessel 10 is turning in a counterclockwise direction (i.e., towards the port side 32) the controller 62 may select a portion 502 (see FIG. 5) of the image data from the fore-facing imaging sensor 36 and its FOV 50 and port imaging sensor 40 and a its FOV 58. Imaging the marine environment off of the bow end 30 of the vessel 10 in the direction of the turn is advantageous because the bow of the vessel typically moves the most when a vessel turns, and will thus be of most interest to the operator when the vessel is turning. In some embodiments, the user interface display 300 may be configured to include more than one image display 316 to display multiple selected portions of the generated image data that cannot reasonably be combined into a single image. In such an embodiment, for example, when the propulsion direction includes a yaw component without a significant surge or sway component (e.g., where the yaw component of propulsion has the greatest magnitude), the area surrounding the stern 22 of the vessel 10 may also be of particular interest to an operator in addition to the area surrounding the bow in the direction of rotation. Accordingly, controller 62 may additionally select a portion 504 of the image data generated by the aft-facing imaging sensor(s) 46 and its FOV 52 and starboard imaging sensor 42 and its FOV 56 (see FIG. 5). The controller 62 may then display the portion(s) of the image data from the imaging sensors 42, 46 on the user interface display 300 in a separate image display 316 from the image display 316 used to display the image data from the fore-facing imaging sensor 36. Thus, image data is shown ahead of both the bow and the stern in the direction of turn, such as showing the water surface ahead of the bow movement and the stern movement. For example, if the vessel is rotating substantially in place turning clockwise about its COT, the control system will select image data showing the starboard side of the bow and the port side of the stern.

Returning to FIG. 3, as the controller 62 is commanding the marine drives 12-18 to complete the autodocking process along the predicted travel path 310, an object (e.g., obstacle vessel 312) may be detected as the nearest object to the vessel 10. Object detection within the image data may be performed using any known methods, for example, the methods disclosed in U.S. Pat. No. 10,372,976, incorporated herein by reference in its entirety. If an object is detected within the predicted travel path 310, the controller 62 may select or update the image data generated by one or more of the imaging sensors 36-46 and displayed in the image display 316 to clearly depict the detected object for the operator. For example, the controller 62 may select portions of the image data that center the object within the image display 316. Alternatively or additionally, the controller 62 may cause the object to be displayed in a particular color within the image display 316 (see object 320) to alert the operator to the presence of the object. In still further examples, the controller 62 may display a text-based alert message 322 to alert the operator to the presence of the object and may automatically pause performance of the autodocking process responsive to the detected object and/or a determination that the detected object is within a threshold distance range and/or of a particular object type or category to be of concern (e.g., a swimmer). Command buttons 324 included within the user interface display 300 may further permit the operator to exit the autodocking operation mode or to stop all propulsion from the marine drives 12-18 due to an emergency.

Figure 6:
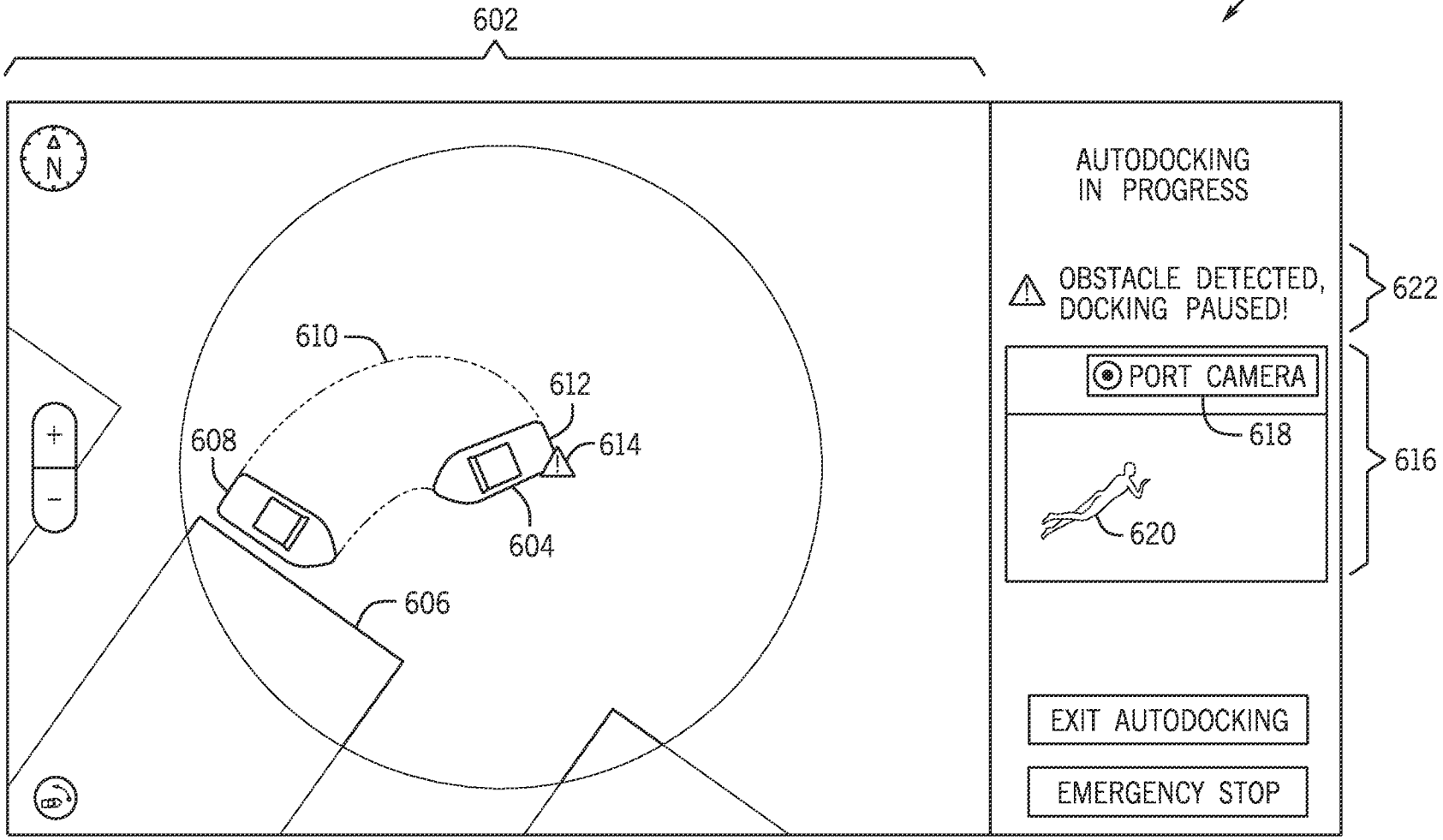
FIG. 6 illustrates an exemplary display populated by image data from the imaging system of FIG. 1 during another docking operation.
Figure 7:
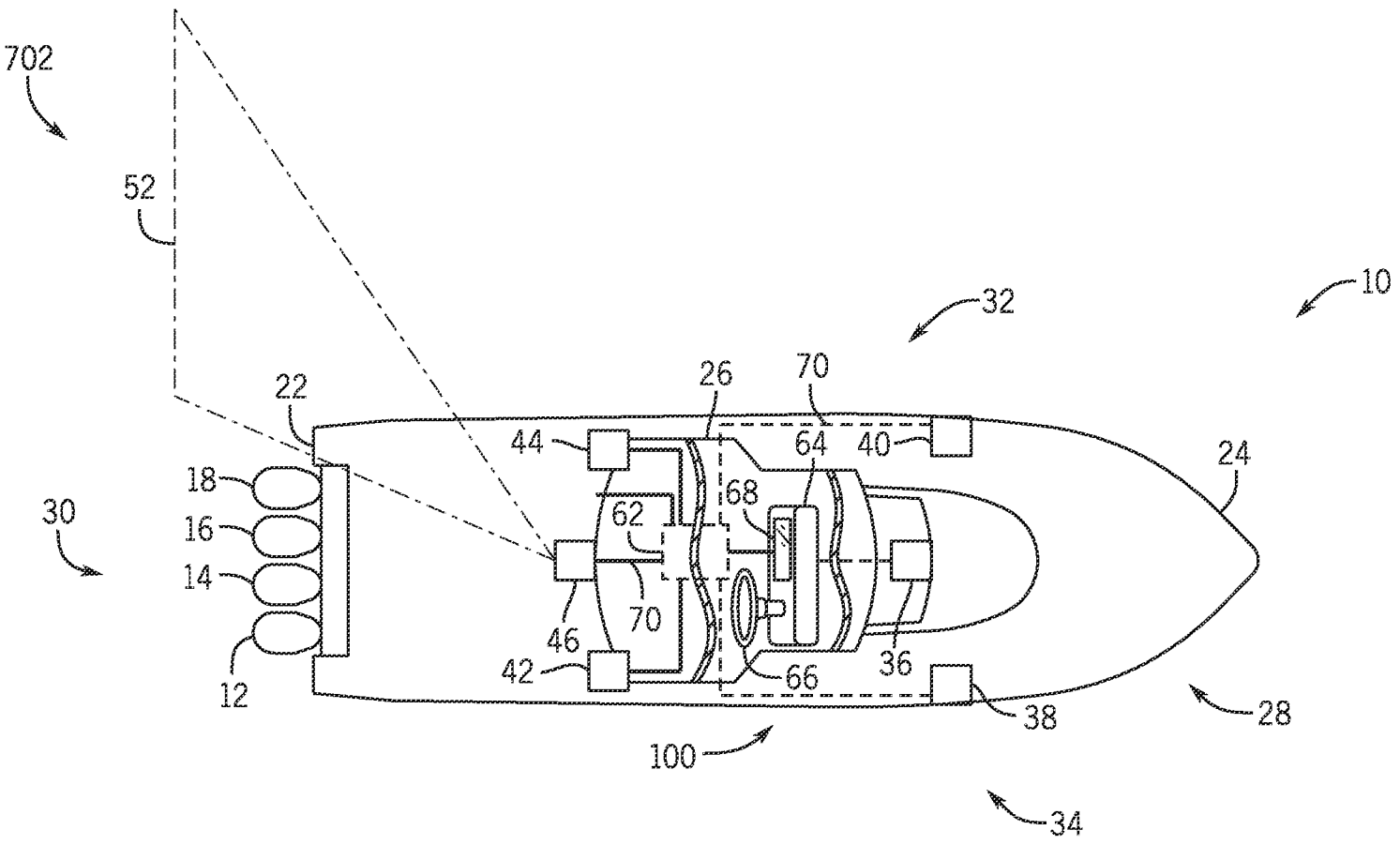
FIG. 7 illustrates a top view of the marine vessel of FIG. 1 during the docking operation of FIG. 6.

Turning now to FIGS. 6 and 7, another exemplary operation of the imaging system 100 during an autodocking procedure is depicted. FIG. 6 depicts a user interface display 600 that may be displayed to an operator on a display device (e.g., display device 68). In an exemplary embodiment, the user interface display 600 includes a navigation display component 602 that depicts an icon 604 of the vessel 10 and corresponds to the current position of the vessel. To initiate the autodocking procedure according to known methods, an operator may select a docking target (e.g., dock structure 606). Based on the docking target, the controller 62 may determine a target navigation location 608 for the vessel 10 using a predicted travel path 610.

The controller 62 may be further configured to impose a virtual perimeter 612 around the vessel 10. The size of the perimeter 612 may be configurable by an operator or automatically determined by the controller 62. In addition, the size of the perimeter 612 may be variable based on its relative position to the vessel 10. For example, the perimeter 612 may be larger proximate the marine drives 12-18 as compared with a perimeter size off of the port or starboard sides of the hull 24 due to the dangers associated with objects contacting the drives and the potential need to detect objects in the vicinity of the drives sooner than objects in the vicinity of the port or starboard sides of the hull. If an object is detected anywhere within a threshold distance corresponding to the perimeter, the controller 62 is configured to select and display portions of the image data on an image display 616 that depict the object, even if the object is not within the predicted travel path 610 of the vessel 10. In such cases, the controller 62 may be configured to replace the image data that is currently displayed on the image display 616 with image data that displays the detected object.

For example, as depicted in FIG. 6, an object 614 (e.g., a swimmer) is detected within the virtual perimeter 612 proximate the stern of the vessel 10. The controller 62 thus selects a portion of the image data (in this case, a portion 702 of the image data within the port side FOV 52 of the imaging sensor 46, see FIG. 7) to display on image display 616. As described above with reference to FIG. 3, in various embodiments, the image display 616 may include an imaging sensor label 618 to indicate the position of the one or more imaging sensors providing the image data for the image display 616, and the detected object may be displayed in a particular color (see object 620) to alert the operator to the presence of the object. In still further examples, the controller 62 may display a text-based alert message 622 to alert the operator to the presence of the detected object and perform an emergency stop, if required.

Figure 8:
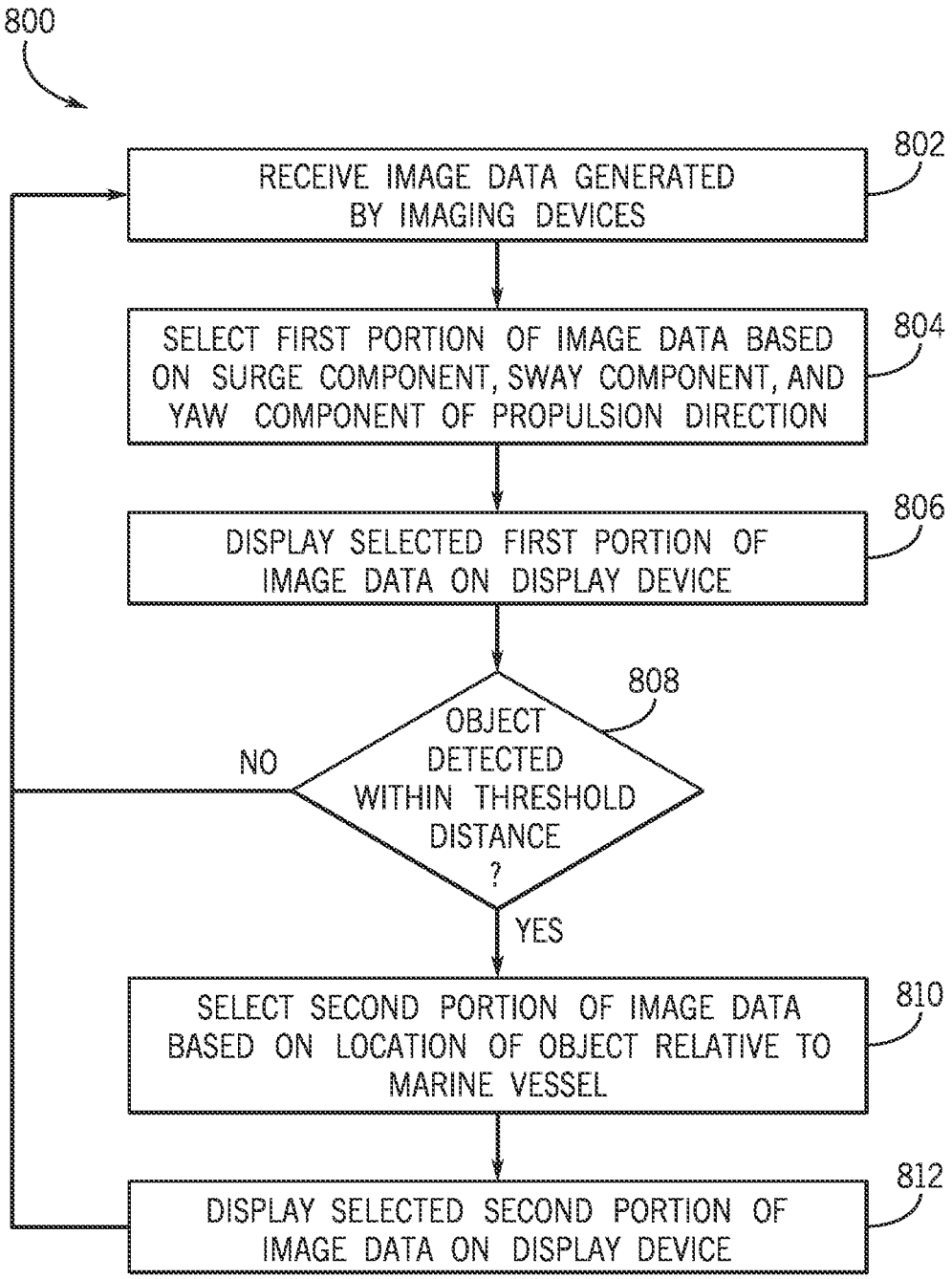
FIGS. 8 and 9 are flow charts of exemplary methods for controlling an imaging system.

Referring now to FIG. 8, a method 800 for controlling the imaging system 100 on the marine vessel 10 is shown. In an exemplary embodiment, the method 800 is performed by the controller 62. Method 800 commences with step 802, as the controller 62 receives image data generated by one or more of the imaging sensors 36-46 installed on the marine vessel 10. As described above, the imaging sensors 36-46 may be positioned on the vessel 10 such that every direction in the surrounding marine environment is within at least one FOV 50-60 of the imaging sensors 36-46.

Method 800 continues with step 804, as the controller 62 selects a first portion of the image data based on the surge, sway, and/or components of the propulsion direction of the vessel 10. The selected first portion of the image data may comprise image data from a single imaging sensor, or image data that is combined from multiple imaging sensors. If the commanded propulsion direction includes a forward or rearward surge component, the selected portion may generally comprise image data from imaging sensors 36 and 46, respectively. If the commanded propulsion direction includes a sway component, the selected portion may generally comprise image data from imaging sensors 36-46 spanning the port or starboard sides of the vessel, depending on the commanded sway direction. If the commanded propulsion direction includes a yaw component, the selected portion may generally comprise image data from imaging sensors 36 and 46. As described above with reference to FIGS. 3-5, in other embodiments, the selection of the first portion of the image data may be additionally be based or modified on a target navigation location of the vessel 10, its predicted travel path, and/or the presence of an object detected within the predicted travel path.

At step 806, the controller 62 causes the first portion of the image data selected at step 804 to be displayed on a display device (e.g., display device 68). As shown in FIG. 3, in one embodiment, the image display 316 may display a label (e.g., label 318) identifying the position of the imaging sensor(s) from which the image data has been selected. If present, an object detected within the predicted travel path may also be depicted in a particular color (e.g., object 320).

At step 808, the controller 62 determines whether an object has been detected within a threshold distance (e.g., virtual perimeter 612) of the marine vessel 10. If no object has been detected, method 800 reverts to step 802 and the controller 62 continues to update the selected portions of the image data based on the propulsion direction and/or the presence of detected objects. However, if the controller 62 does detect an object within the threshold distance, method 800 proceeds to step 810 in which the controller 62 selects a second portion of the image data based on the location of the detected object relative to the vessel 10. For example, as depicted in FIG. 6, if an object is detected proximate the stern of the vessel 10, the selected second portion may comprise image data from an aft-facing imaging sensor (e.g., imaging sensor 46).

In some embodiments, the controller 62 may impose additional criteria other than the presence of an object within the threshold distance to determine a selected second portion of the image data. Alternatively or additionally, the controller 62 may vary the threshold distance based on the type of object detected. For example, if the controller 62 detects another moored vessel within the FOV 52 captured by the imaging sensor 46 (see FIG. 7) and the propulsion direction of the vessel 10 is a forward surge, the controller 62 may determine that the detected object (i.e., the moored vessel) does not pose a threat to the vessel 10 and therefore may not select a second portion of the image data to display to the operator depicting the moored vessel. By contrast, if the controller 62 detects another vessel moving with the FOV 52 captured by the imaging sensor 46, the controller 62 may determine that the moving vessel poses a threat to the vessel 10 and may display a selected second portion of the image data from imaging sensor 46 even if the moving vessel is not yet within the threshold distance.

At step 812, the selected second portion of the image data is displayed on the display device. In some embodiments, the selected second portion of the image data simply replaces the selected first portion of the image data that was displayed at step 806. In other embodiments, the selected second portion of the image data may be displayed in addition to the selected first portion of the image data. Method 800 then proceeds to revert to step 802 as the controller 62 continues to update and display the selected portions of the image data.

Figure 9:
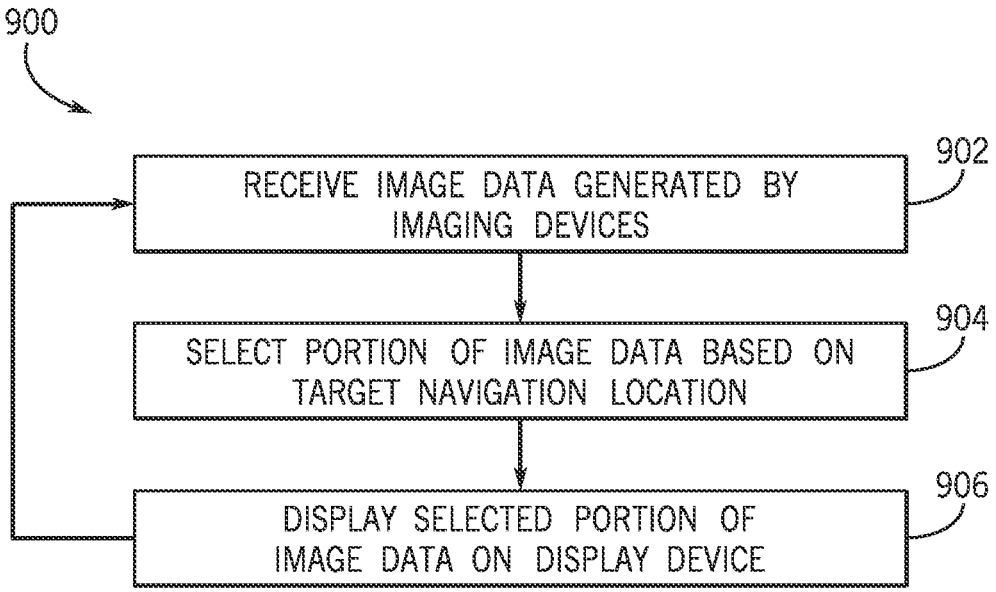

Referring now to FIG. 9, another method 900 for controlling the imaging system 100 on the marine vessel 10 is shown. In an exemplary embodiment, the method 900 is performed by the controller 62. Method 900 commences with step 902, as the controller 62 receives image data generated by one or more of the imaging sensors 36-46 installed on the marine vessel 10. As described above, the imaging sensors 36-46 may be positioned on the vessel 10 such that every direction in the surrounding marine environment is within at least one FOV 50-60 of the imaging sensors 36-46. Data from the image sensors 36-46 may be utilized to generate an occupancy grid integrating location information from multiple sensors.

At step 904, the controller 62 selects a portion of the image data based on a target navigation location (e.g., a docking location, a waypoint) of the vessel 10. For example, if the target navigation location is the target navigation location 308 depicted in FIG. 3, the controller 62 may initially select portions of the image data from image sensors 36-40 that image the area in front of the bow of the marine vessel 10 because the target navigation location 308 is located in front of the vessel 10.

Continuing with step 906, the controller 62 causes the portion of the image data selected at step 904 to be displayed on a display device (e.g., display device 68). Method 900 then reverts to step 902 and method 900 may be performed continuously as the vessel 10 approaches the target navigation location 308 to ensure that the target navigation location 308 remains visible to the operator. For example, if the marine vessel 10 approaches the target navigation location 308 by rotating in a counterclockwise direction, as shown by the predicted travel path 310, subsequent performances of steps 902-906 may include the controller 62 selecting portions 402 of the image data from image sensors 36, 38, 42, and 46 (see FIG. 4) to image the environment surrounding the starboard side of the vessel 10 as the starboard side of the vessel 10 approaches the target navigation location 308. In various embodiments, the controller 62 may continue to perform object detection on the image data received at step 902, and may interrupt or supplement the image data displayed on the display device based on the detected object(s) meeting various criteria (e.g., within a specified distance threshold, moving toward the vessel).

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. An imaging system for a marine vessel having a propulsion system configured to provide thrust that propels the marine vessel in a propulsion direction having a surge component, a sway component, and a yaw component, the system comprising:

a plurality of imaging sensors positioned to image a plurality of directions around the marine vessel and configured to generate image data;

a display device configured to display at least a portion of the image data;

a control system configured to:

select a first portion of the image data based on each of the surge component, the sway component, and the yaw component of the propulsion direction; and display the selected first portion of the image data on the display device.

2. The system of claim 1, wherein the control system is configured to select the first portion of the image data based further on a target navigation location with respect to the marine vessel.

3. The system of claim 1, wherein the control system is configured to select the first portion of the image data based further on a nearest detected object in a predicted travel path of the marine vessel.

4. The system of claim 1, wherein the control system is further configured to:

detect an object within a threshold distance of the marine vessel;

select a second portion of the image data based on a location of the object relative to the marine vessel; and display the selected second portion of the image data on the display device.

5. The system of claim 4, wherein displaying the selected second portion of the image data on the display device comprises switching the display from the selected first portion of the image data to the selected second portion of the image data.

6. The system of claim 4, wherein displaying the selected second portion of the image data on the display device comprises displaying the selected second portion of the image data in addition to the selected first portion of the image data.

7. The system of claim 1, wherein:

the propulsion direction comprises a sway component that is nonzero; and the selected first portion of the image data comprises image data that covers an entire length of the marine vessel from a bow to a stern including image data from at least one port imaging sensor configured to image an area proximate a port side of the marine vessel or at least one starboard imaging sensor configured to image an area proximate a starboard side of the marine vessel.

8. The system of claim 1, wherein:

the propulsion direction comprises a yaw component that is nonzero; and the selected first portion of the image data comprises image data from at least one fore imaging sensor configured to image an area proximate a bow of the marine vessel.

9. The system of claim 8, wherein the control system is further configured to:

select a second portion of the image data comprising image data from at least one aft imaging sensor configured to image an area proximate a stern of the marine vessel; and display the selected second portion of the image data on the display device.

10. The system of claim 1, wherein the selected first portion of the image data is a combined image comprising image data from at least two of the plurality of imaging sensors.

11. A method for controlling an imaging system for a marine vessel having a propulsion system configured to provide thrust that propels the marine vessel in a propulsion direction having a surge component, a sway component, and a yaw component, the method comprising:

imaging a plurality of directions around the marine vessel to generate image data using a plurality of imaging sensors;

selecting a first portion of the image data based on each of the surge component, the sway component, and the yaw component of the propulsion direction; and displaying the selected first portion of the image data on a display device.

12. The method of claim 11, wherein selecting the first portion of the image data is based further on a target navigation location with respect to the marine vessel.

13. The method of claim 11, wherein selecting the first portion of the image data is based further on a nearest detected object in a predicted travel path of the marine vessel.

14. The method of claim 11, wherein the method further comprises:

detecting an object within a threshold distance of the marine vessel;

selecting a second portion of the image data based on a location of the object relative to the marine vessel; and displaying the selected second portion of the image data on the display device.

15. The method of claim 14, wherein displaying the selected second portion of the image data on the display device comprises switching the display from the selected first portion of the image data to the selected second portion of the image data.

16. The method of claim 14, wherein displaying the selected second portion of the image data on the display device comprises displaying the selected second portion of the image data in addition to the selected first portion of the image data.

17. The method of claim 11, wherein:

the propulsion direction comprises a sway component that is nonzero; and the selected first portion of the image data comprises image data that covers an entire length of the marine vessel from a bow to a stern including image data from at least one port imaging device configured to image an area proximate a port side of the marine vessel or at least one starboard imaging sensor configured to image an area proximate a starboard side of the marine vessel.

18. The method of claim 11, wherein:

the propulsion direction comprises a yaw component that is nonzero; and the selected first portion of the image data comprises image data from at least one fore imaging sensor configured to image an area proximate a bow of the marine vessel.

19. The method of claim 18, wherein the method further comprises:

selecting a second portion of the image data comprising image data from at least one aft imaging sensor configured to image an area proximate a stern of the marine vessel; and displaying the selected second portion of the image data on the display device.

20. The method of claim 11, wherein the selected first portion of the image data is a combined image comprising image data from at least two of the plurality of imaging sensors.

* * * * *